US009348308B2

(12) United States Patent
Toriyama et al.

(10) Patent No.: US 9,348,308 B2
(45) Date of Patent: May 24, 2016

(54) PROCESS CARTRIDGE HAVING FORCE RECEIVING PORTION AND IMAGE FORMING APPARATUS INCLUDING PROCESS CARTRIDGE

(71) Applicant: CANON KABUSHIKI KAISHA, Tokyo (JP)

(72) Inventors: Yasunori Toriyama, Numazu (JP); Masato Tanabe, Susono (JP); Keisuke Nomura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/900,980

(22) Filed: May 23, 2013

(65) Prior Publication Data

US 2013/0315621 A1 Nov. 28, 2013

(30) Foreign Application Priority Data

May 24, 2012 (JP) ..... 2012-118788

(51) Int. Cl.
*G03G 21/18* (2006.01)

(52) U.S. Cl.
CPC ..... *G03G 21/1853* (2013.01); *G03G 21/185* (2013.01); *G03G 21/1825* (2013.01); *G03G 2215/0617* (2013.01)

(58) Field of Classification Search
CPC ..... G03G 21/1825; G03G 21/185; G03G 21/1853; G03G 2215/0617; G03G 2221/1861
USPC ..... 399/111, 113
See application file for complete search history.

(56) References Cited

U.S. PATENT DOCUMENTS

| | | | | |
|---|---|---|---|---|
| 2009/0290905 | A1* | 11/2009 | Mizuno et al. | 399/111 |
| 2011/0103829 | A1* | 5/2011 | Kanno et al. | 399/111 |
| 2011/0280620 | A1* | 11/2011 | Chadani et al. | 399/111 |
| 2012/0275815 | A1* | 11/2012 | Koyama et al. | 399/111 |

FOREIGN PATENT DOCUMENTS

| | | | |
|---|---|---|---|
| CN | 1728013 | A | 2/2006 |
| JP | 2006-276190 | A | 10/2006 |
| JP | 2007-213018 | A | 8/2007 |
| JP | 2008-170950 | A | 7/2008 |
| JP | 2010-190977 | A | 9/2010 |

* cited by examiner

*Primary Examiner* — David Gray
*Assistant Examiner* — Laura Roth
(74) *Attorney, Agent, or Firm* — Canon USA, Inc. IP Division

(57) ABSTRACT

A process cartridge detachable from an image forming apparatus main body which includes an image bearing member, a developer bearing member, a developing frame member to support the developer bearing member and is able to assume an abutting state and a separating state, a force receiving portion configured to allow the developing frame member to enter the separating state by being pressed by a pressing portion where the force receiving portion includes a first portion to abut on the pressing portion and to extend along the inserting direction of the process cartridge, and a second portion provided on each of an upstream and downstream side of the first portion in the inserting direction.

22 Claims, 11 Drawing Sheets

PROCESS CARTRIDGE HAVING FORCE RECEIVING PORTION AND IMAGE FORMING APPARATUS INCLUDING PROCESS CARTRIDGE

BACKGROUND OF THE INVENTION

1. Field of the Invention

Aspect of the present invention relate to a process cartridge and an image forming apparatus detachably equipped with a process cartridge.

2. Description of the Related Art

An image forming apparatus detachably equipped with a process cartridge has been known. This process cartridge includes a developing unit equipped with at least a developing roller and a developing frame member, and a photosensitive member unit equipped with at least a photosensitive drum and a cleaning frame member. And, the developing roller is brought into contact with a photosensitive drum on which an electrostatic latent image is formed, whereby the electrostatic latent image is developed to form a toner image as a developed image. This system, in which development is performed by bringing a developing roller into contact with a photosensitive member drum, is referred to as a contact developing method.

In this contact developing method, the developing roller is kept pressed against the photosensitive drum so that the developing roller and the photosensitive drum maintain a predetermined abutting pressure. Thus, an elastic layer on the surface of the developing roller undergoes deformation, resulting in a defective image. To cope with this problem, it might be possible, for example, to select a material little subject to deformation for the elastic layer on the surface of the developing roller, or to strictly control the manufacturing conditions. That, however, may involve an increase in cost.

In view of this, Japanese Patent Application Laid-Open No. 2008-170950 discusses a configuration in which the developing roller is kept away from the photosensitive drum by means of a separation member during the non-image-formation period in which no image formation is performed.

Further, also in a configuration as discussed in Japanese Patent Application Laid-Open No. 2010-190977 (see FIG. 11), it is possible to separate a developing roller 17 from a photosensitive drum 1. In the configuration illustrated in FIG. 11, development separation portions 70 (70*a* and 70*b*) are provided at two positions in a developing unit 4, i.e., on the upstream side and the downstream side of a process cartridge 7. And, when the process cartridge 7 is attached, the development separation portions 70 (70*a* and 70*b*) of the process cartridge 7 are pressed by a guide member 29 provided in the image forming apparatus main body, whereby the developing roller 17 is separated from the photosensitive drum 1.

In the above-described configuration illustrated in FIG. 11, the development separation portions 70 of the process cartridge 7 are engaged with a groove provided in the guide member 29 in a state in which the attachment of the process cartridge 7 to the image forming apparatus has been completed. In a configuration like this, in which there is a difference in height between the guide member 29 and the grove, the operability when attaching the process cartridge 7 may be affected. Further, the guide member 29 provided in the image forming apparatus main body is formed so as to extend from the upstream side to the downstream side in the attachment direction of the process cartridge 7, which means it leaves room for an improvement in terms of space saving inside the image forming apparatus main body.

SUMMARY OF THE INVENTION

The present disclosure is directed to achieving an improvement in terms of operability at the time of attachment/detachment of a process cartridge and to realize space saving (a reduction in size) of the process cartridge and an image forming apparatus.

According to an aspect of the present disclosure, a process cartridge detachably attachable to an image forming apparatus main body includes an image bearing member, a developer bearing member configured to abut on the image bearing member to thereby develop an electrostatic latent image formed on the image bearing member, a developing frame member configured to support the developer bearing member and to be capable of assuming an abutting state in which the developer bearing member abuts on the image bearing member and a separating state in which the developer bearing member separates from the image bearing member, and a force receiving portion provided on the developing frame member and configured to allow the developing frame member to enter the separating state by being pressed by a pressing portion provided in the image forming apparatus main body, in which the force receiving portion includes a first portion configured to abut on the pressing portion when the process cartridge is inserted from the exterior into the interior of the image forming apparatus main body and to extend along the inserting direction of the process cartridge, and a second portion provided on each of an upstream side and on a downstream side of the first portion in the inserting direction, extending from the first portion in a direction crossing the inserting direction, and configured to abut on the pressing portion when the process cartridge is at a position where image formation is possible, and the force receiving portion has a space formed between the two second portions provided on the upstream side and the downstream side of the first portion.

According to another aspect of the present disclosure, an image forming apparatus configured to form an image on a recording material includes a process cartridge detachably attachable to an image forming apparatus main body and a pressing portion configured to press a force receiving portion provided in the process cartridge, in which the process cartridge includes an image bearing member, a developer bearing member configured to abut on the image bearing member to thereby develop an electrostatic latent image formed on the image bearing member, a developing frame member configured to support the developer bearing member and to be capable of assuming an abutting state in which the developer bearing member abuts on the image bearing member and a separating state in which the developer bearing member separates from the image bearing member and the force receiving portion provided on the developing frame member and configured to allow the developing frame member to enter the separating state by being pressed by a pressing portion provided in the image forming apparatus main body, in which the force receiving portion includes a first portion configured to abut on the pressing portion when the process cartridge is inserted from the exterior into the interior of the image forming apparatus main body and to extend along the inserting direction of the process cartridge, and a second portion provided on each of an upstream side and on a downstream side of the first portion in the inserting direction, extending from the first portion in a direction crossing the inserting direction, and configured to abut on the pressing portion when the process cartridge is at a position where image formation is possible, and the force receiving portion has a space formed between the two second portions provided on the upstream side and the downstream side of the first portion.

Further features of the present disclosure will become apparent from the following description of exemplary embodiments with reference to the attached drawings.

DESCRIPTION OF THE EMBODIMENTS

Overall Configuration of the Image Forming Apparatus

Figure 1:
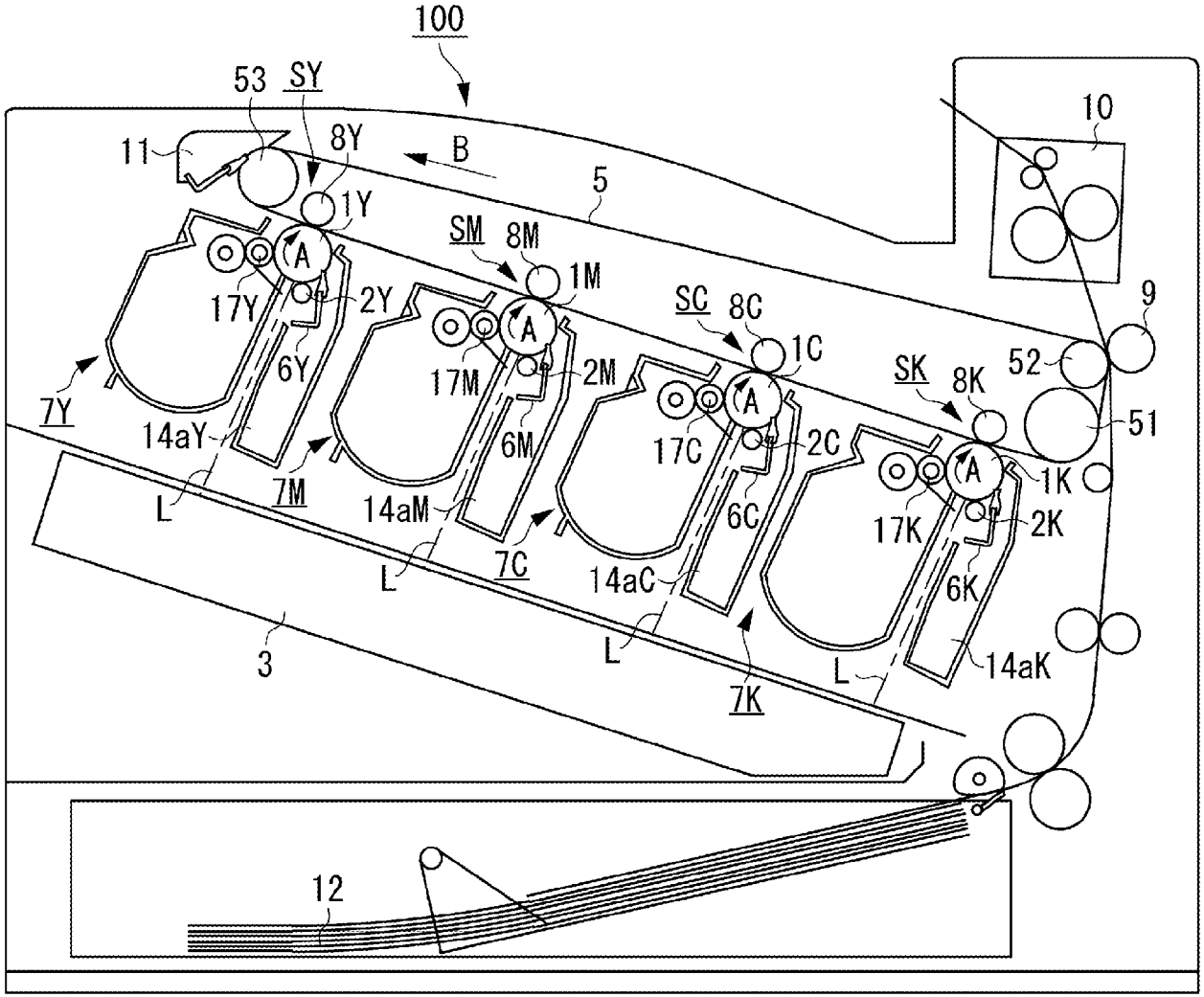
FIG. 1 is a schematic sectional view illustrating the overall configuration of an image forming apparatus according to an exemplary embodiment.

First, the overall configuration of an image forming apparatus according to the present exemplary embodiment will be described with reference to FIG. 1. By way of example, the image forming apparatus according to the present exemplary embodiment described below using a laser beam printer. However, this should not be construed restrictively. The image forming apparatus may also be a copying machine, a light-emitting diode (LED) printer, a word processor, a facsimile apparatus, or a multifunction apparatus combining thereof. FIG. 1 is a schematic sectional view illustrating the overall configuration of the image forming apparatus according to the present exemplary embodiment. In the image forming apparatus according to the present exemplary embodiment, there are arranged, in a row, first through fourth image forming units SY, SM, SC, and SK for respectively forming a yellow (Y) image, a magenta (M) image, a cyan (C) image, and a black (K) image. The first through fourth image forming units SY, SM, SC, and SK are substantially the same except that they form images in different colors. Thus, while in the following description the suffixes Y, M, C, and K are used to indicate for what color a component is used, these suffixes will be omitted where there is no particular need to be distinguished.

The image forming apparatus according to the present exemplary embodiment has, as a plurality of image bearing members, four photosensitive drums 1. The photosensitive drums 1 are provided so as to be rotatable in the direction of the arrow A in FIG. 1. Further, around each photosensitive drum 1, a charging roller 2 and a scanner unit (exposure device) 3 are arranged. The charging roller 2 is provided so as to be in contact with the surface of the photosensitive drum 1, and is configured to uniformly charge the surface of the photosensitive drum 1. The scanner unit 3 irradiates the surface of charged photosensitive drum 1 with laser light L based on image information, thereby forming an electrostatic image (electrostatic latent image) thereon.

Further, around each photosensitive drum 1, a developing roller 17 as a developer bearing member and a cleaning member 6 are arranged. The developing roller 17 develops the electrostatic image formed on the photosensitive drum 1, thereby forming a toner image as a developed image. The cleaning member 6 is provided so as to be in contact with the surface of the photosensitive drum, and is configured to remove toner as the developer remaining on the surface of the photosensitive drum 1. The present exemplary embodiment employs, as the developer, a toner which is a non-monocomponent developer. As the developing system, the present exemplary embodiment employs a contact developing system, in which development is performed with the developing roller 17 being held in contact with the photosensitive drum 1.

Further, the image forming apparatus according to the present exemplary embodiment has an intermediate transfer belt 5 formed as an endless belt and provided so as to be in contact with all the photosensitive drums 1. The intermediate transfer belt 5 is suspended by being supported by a driving roller 51, a secondary transfer counter roller 52, and a driven roller 53, and is circulated in the direction of the arrow B of FIG. 1. Primary transfer rollers 8 are provided side by side on the inner peripheral surface side of the intermediate transfer belt 5 so as to be opposed to the photosensitive drums 5. Further, a secondary transfer roller 9 is arranged on the outer peripheral surface side of the intermediate transfer belt 5 at a position opposed to the secondary transfer counter roller 52.

The toner images formed on the surfaces of the photosensitive drums 1 are primarily transferred onto the intermediate transfer belt 5 by the primary transfer rollers 8. At the time of full-color image formation, the toner images of the different colors are successively superimposed on each other at the first through fourth image forming units SY, SM, SC, and SK to be primarily transferred to the intermediate transfer belt 5. After this, a recording material 12 such as a paper sheet or the like is conveyed to the secondary transfer roller 9 in synchronism with the movement of the intermediate transfer belt 5. And, owing to the action of the secondary transfer roller 9 abutting on the intermediate transfer belt 5 through the intermediation of the recording material 12, the toner images of the four colors formed on the intermediate transfer belt 5 are collectively secondarily transferred onto the recording material 12. Any primary transfer residual toner remaining on the photosensitive drums 1 (photosensitive members) after the primary transfer, is removed by the cleaning members 6 and is dropped into removable toner chambers 14*a* to be recovered therein. Any secondary transfer residual toner remaining on the intermediate transfer belt 5 after the secondary transfer is removed by an intermediate transfer belt cleaning device 11.

The recording material 12 to which the toner images have been secondarily transferred is conveyed to a fixing device 10 provided in the image forming apparatus. Further, heat and pressure are applied to the recording material 12 at the fixing device 10, whereby the toner images are fixed to the recording material 12. Further, the recording material 12, to which the toner images have been fixed, is discharged to the exterior of the image forming apparatus, whereby a series of image forming operations are completed.

Configuration of the Process Cartridge

Figure 2:
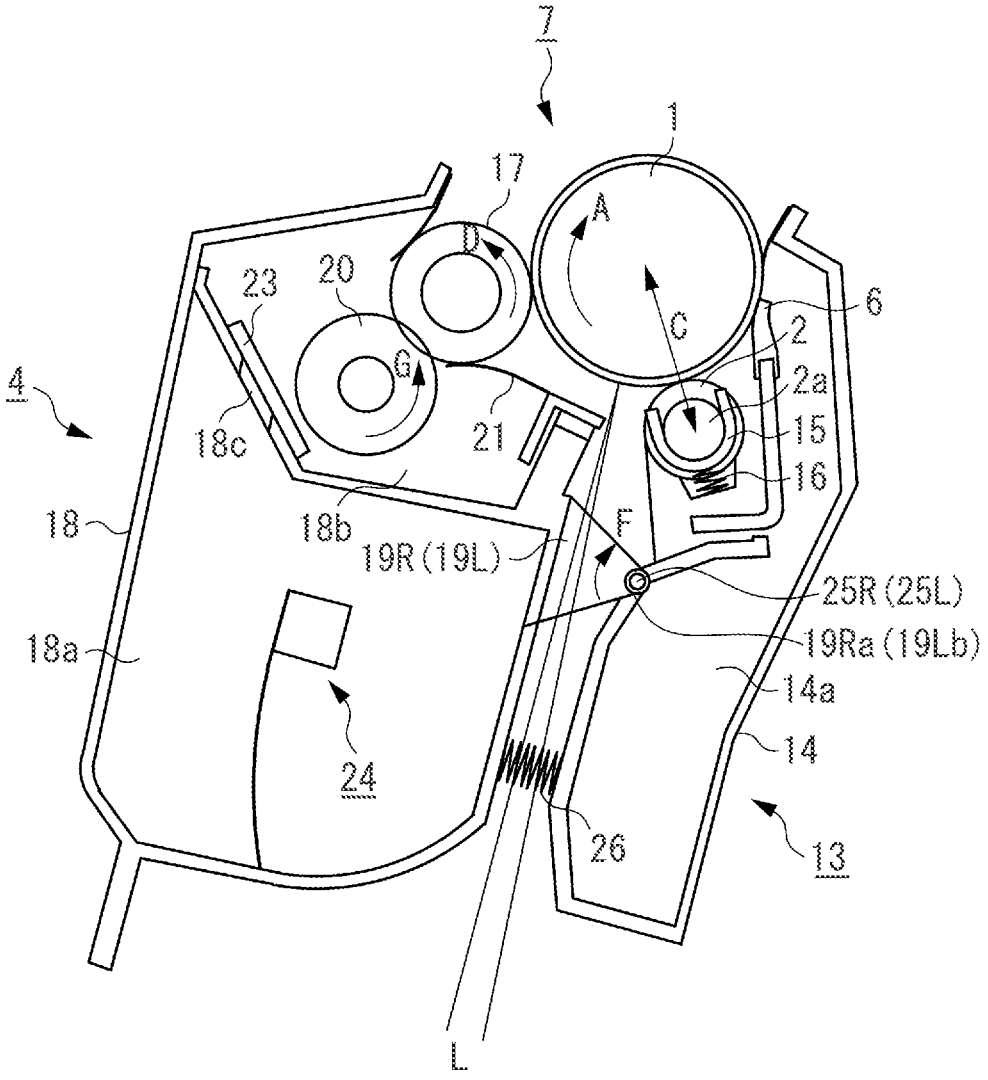
FIG. 2 is a schematic sectional view illustrating the configuration of a process cartridge according to the present exemplary embodiment in an abutting state.

Next, the overall configuration of a process cartridge 7 attached to an image forming apparatus main body 100 according to the present exemplary embodiment will be described with reference to FIG. 2. FIG. 2 is a schematic sectional view of the process cartridge in a state in which the developing roller abuts on the photosensitive drum. The image forming apparatus main body 100 according to the present exemplary embodiment is configured to allow the four process cartridges 7 respectively corresponding to the four colors to be attached/detached. Each process cartridge 7 includes a photosensitive member unit 13 and a developing unit 4. The photosensitive member unit 13 includes the photosensitive drum 1, the charging roller 2, the cleaning member 6, and a cleaning frame member 14 supporting these members. The photosensitive drum 1 is rotatably mounted to the cleaning frame member 14 via a bearing (not illustrated). Further, a charging roller bearing 15 is mounted to the cleaning frame member 14 so as to be movable in the direction of the arrow C of FIG. 2 along a line passing the rotation center of the charging roller 2 and the rotation center of the photosensitive drum 1. Further, a rotation shaft 2*a* of the charging roller 2 is rotatably mounted to the charging roller bearing 15, and the charging roller bearing 15 is provided so as to be urged toward the photosensitive drum 1 by a charging roller pressing spring 16 as an urging unit.

On the other hand, the developing unit 4 includes the developing roller 17, a toner supply roller 20, and a developing frame member 18 supporting these members. The developing roller 17 is supported by the developing frame member 18 via development bearings (not illustrated) respectively mounted to both sides of the developing frame member 18 so as to be rotatable in the direction of the arrow D in FIG. 2. Further, the developing unit 4 includes a developer storage chamber (hereinafter referred to as the toner storage chamber) 18*a* storing toner, and a developing chamber 18*b* in which the developing roller 17 is arranged. An opening 18*c* is provided in the partition separating the toner storage chamber 18*a* and the developing chamber 18*b* from each other. At the time of shipment of the process cartridge 7, a developer seal member 23 for preventing the toner in the toner storage chamber 18*a* from being scattered to the exterior of the process cartridge 7, is provided on the developing chamber 18*b* side surface of the opening 18*c*. After the attachment of the process cartridge 7 to the image forming apparatus main body 100, the developer seal member 23 is pulled in the longitudinal direction, whereby the opening 18*c* is unsealed. In the developing chamber 18*b*, there are arranged the toner supply roller 20 configured to rotate in the direction of the arrow G while being in contact with the developing roller 17, and a developing blade 21 for regulating the toner layer on the developing roller 17. Further, inside the toner storage chamber 18*a*, an agitation member 24 for agitating the stored toner and conveying the toner to the toner supply roller 20 is provided.

Further, the developing unit 4 is connected to the photosensitive member unit 13 so as to be rotatable around fitting shafts 25R and 25L to be fitted with fitting holes 19Ra and 19Lb provided in bearing members 19R and 19L. Further, the developing unit 4 is urged by a pressure spring 26, and, at the time of image formation by the process cartridge 7, the developing unit 4 rotates in the direction of the arrow F in FIG. 2 around the fitting shafts 25R and 25L, whereby the developing roller 17 abuts on the photosensitive drum 1. The state of the developing unit 4 (developing frame member 18) in which the developing roller 17 thus abuts on the photosensitive drum 1 will be referred to as the abutting state, and the state of the developing unit 4 (developing frame member 18) in which the developing roller 17 separates from the developing roller 17 will be referred to as the separating state.

Attachment/Detachment Configuration of the Process Cartridge

Figure 3:
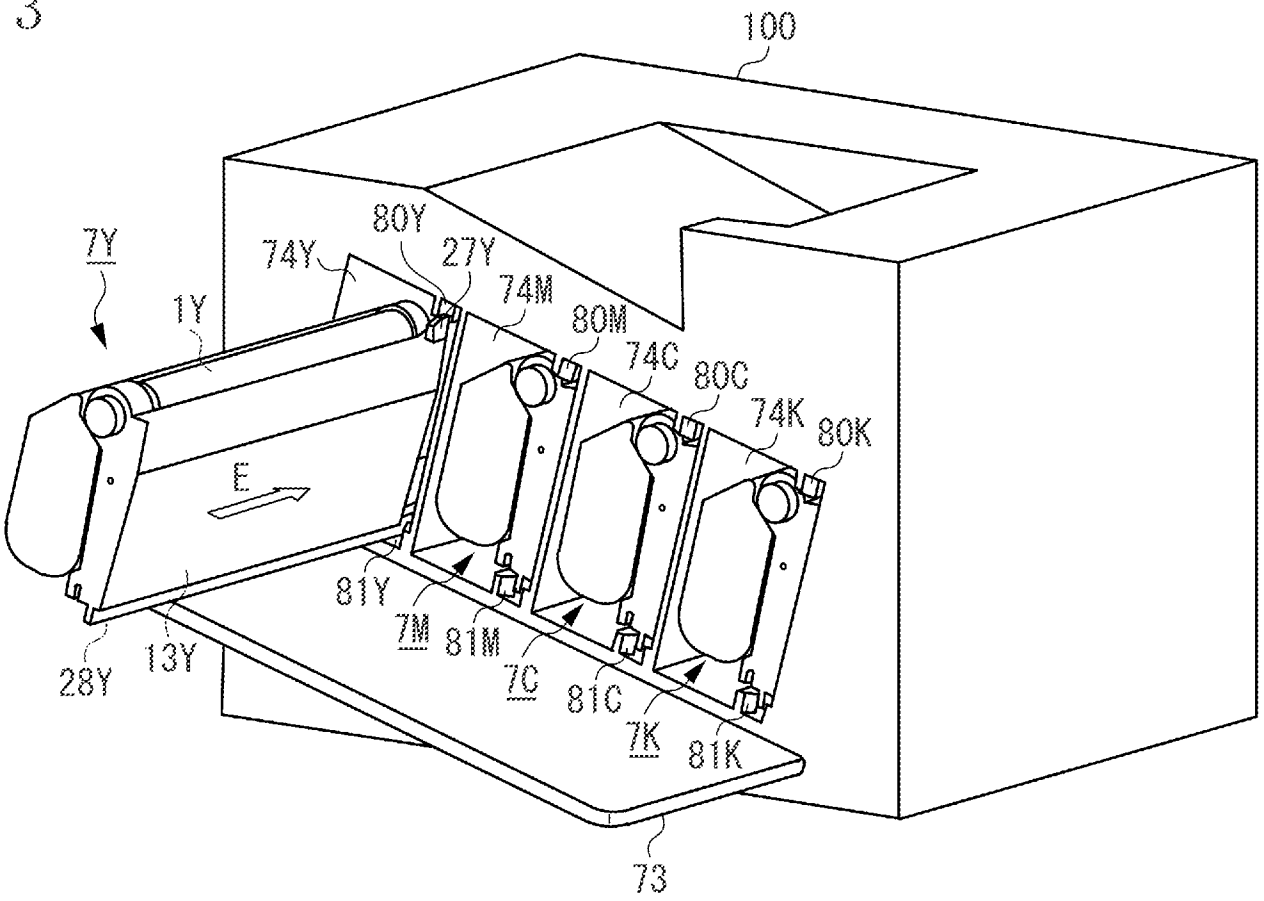
FIG. 3 is a schematic perspective view of the image forming apparatus according to the present exemplary embodiment.

Next, referring to FIG. 3, the configuration for attaching/detaching the process cartridge 7 according to the present exemplary embodiment to/from the image forming apparatus main body 100 will be described. FIG. 3 is a schematic perspective view of the image forming apparatus according to the present exemplary embodiment, illustrating a state before the attachment of a process cartridge. In the present exemplary embodiment, the direction in which the process cartridge 7 is attached to the image forming apparatus main body 100 (the inserting direction) is a direction parallel to the axial direction of the rotation shaft of the photosensitive drum 1 (the direction indicated by the arrow E in FIG. 3). In the present exemplary embodiment, the upstream side in the attachment direction for the process cartridge 7 is defined as the front side, and the downstream side is defined as the rear side. That is, the process cartridge 7 is inserted from the front side to the rear side, whereby the process cartridge 7 can be attached (inserted) from the exterior to the interior of the image forming apparatus main body 100.

As illustrated in FIG. 3, a front cover 73 that can be opened and closed is provided on the front side of the image forming apparatus main body 100. When the front cover 73 is opened, there are exposed four attachment portions 74 which are arranged side by side so as to be inclined with respect to the horizontal direction in which the process cartridges 7 are to be attached. And, on the upper side and the lower side in the vertical direction of each attachment portion 74, there are respectively provided an attachment upper guide portion 80 and an attachment lower guide portion 81 extending from the front side to the rear side of the image forming apparatus main body 100. Further, an upper guide portion 27 is provided on the upper side in the vertical direction of each process cartridge 7 and at a drum rear bearing of the photosensitive member unit 13. Further, on the lower side (bottom surface side) of each process cartridge 7, the photosensitive member unit 13 is provided with a lower guide portion 28. And, the upper guide portion 27 is engaged with the attachment upper guide portion 80, the lower guide portion 28 is engaged with the attachment lower guide portion 81, and the process cartridge 7 is forced-in in the direction of the arrow E in FIG. 3 with respect to the attachment portion 74, whereby the process cartridge can be attached to the image forming apparatus main body 100.

Figure 4:
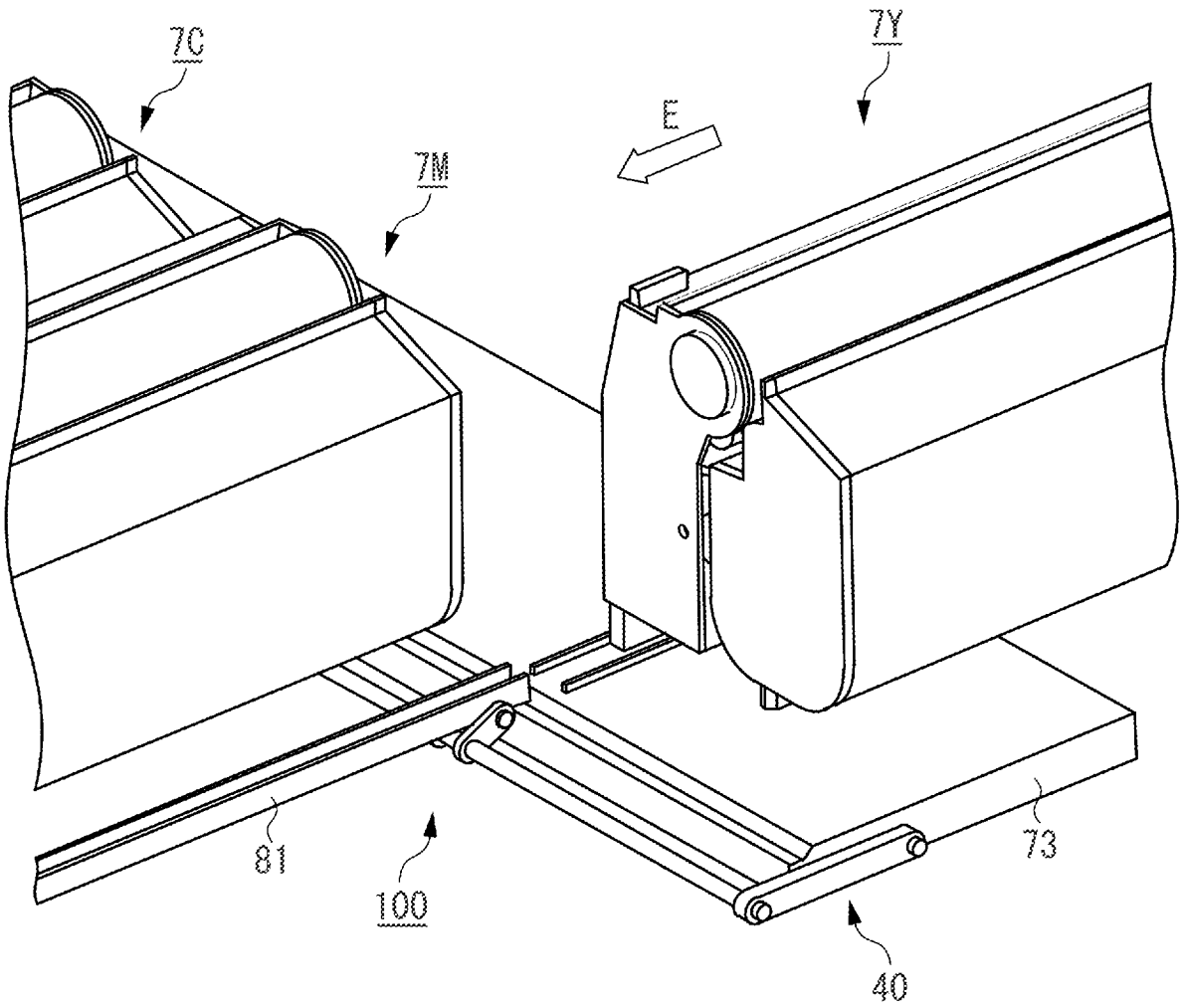
FIG. 4 is a perspective view of an elevation mechanism in the image forming apparatus according to the present exemplary embodiment.
Figure 5A:
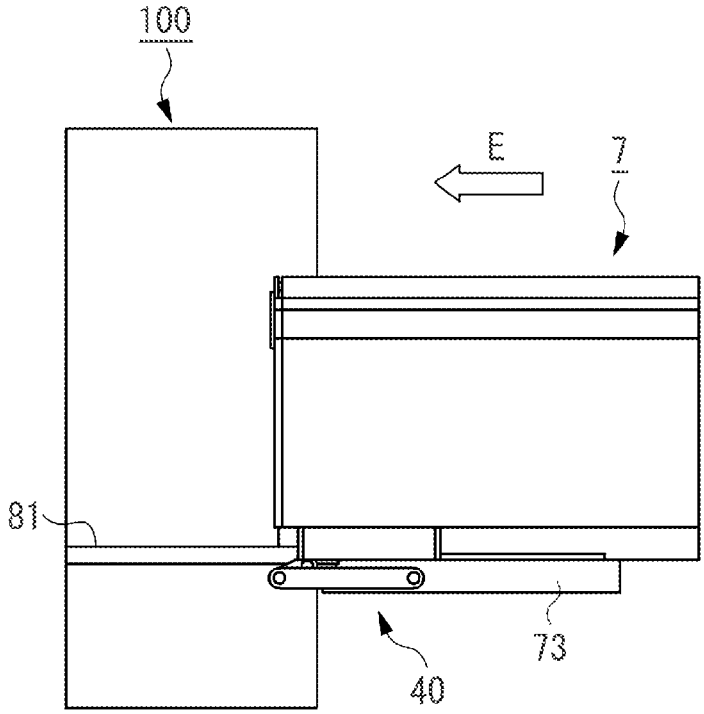
FIGS. 5A and 5B are schematic sectional views illustrating the attachment of the process cartridge according to the present exemplary embodiment.
Figure 5B:
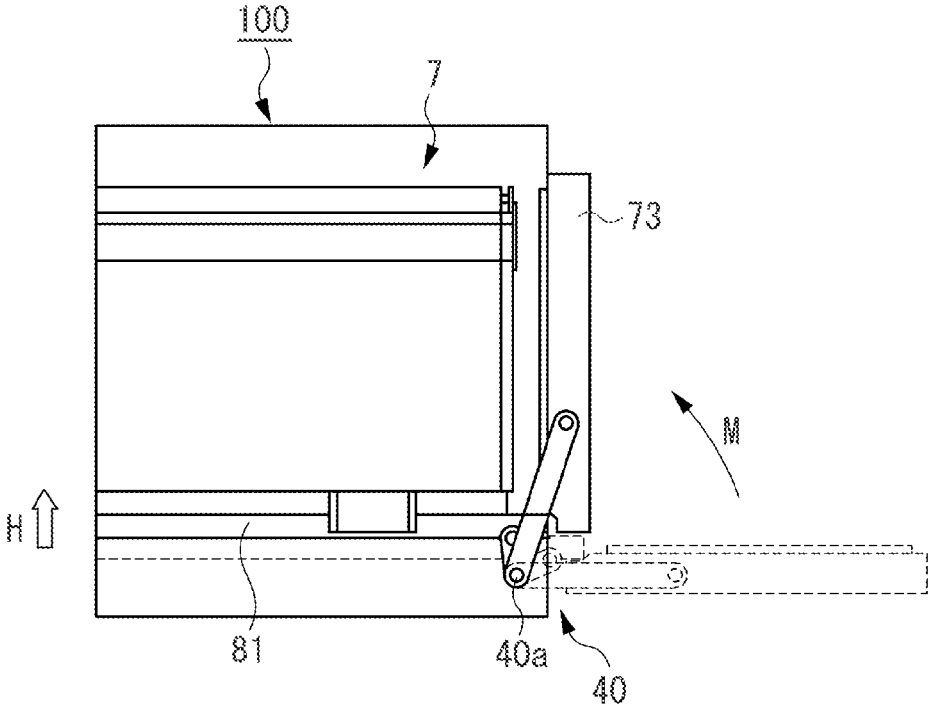

Next, an elevation mechanism (moving mechanism) 40 configured to elevate (move) the attachment lower guide portion 81 provided in the image forming apparatus main body 100 will be described with reference to FIGS. 4, 5A, and 5B. FIG. 4 is a perspective view illustrating an elevation mechanism in the image forming apparatus according to the present exemplary embodiment. FIGS. 5A and 5B are schematic sectional views illustrating the attachment of the process cartridge in the image forming apparatus according to the present exemplary embodiment. FIG. 5A is a schematic sectional view illustrating the process cartridge attachment process (non-attachment position), and FIG. 5B is a schematic sectional view illustrating the process cartridge after attachment of the process cartridge to the image forming apparatus main body.

Here, as indicated by the broken line in FIG. 5B, in a state in which the attachment (insertion) of the process cartridge 7 to the interior of the image forming apparatus main body 100 has been completed, the position of the process cartridge 7 when the front cover 73 is open will be defined as the attachment position (first attachment position). Further, as indicated by the solid line in FIG. 5B, in a state in which the attachment of the process cartridge 7 to the image forming apparatus main body 100 has been completed, the position of the process cartridge 7 when the front cover 73 is closed will be defined as the image forming position (second attachment position). This image forming position is a position where the relative position of the developing frame member 18 and the image forming apparatus main body 100 has been displaced from the relative position at the attachment position.

As illustrated in FIG. 4, the image forming apparatus main body 100 is provided with the elevation mechanism 40 including a link mechanism in which the attachment lower guide portion 81 and the front cover 73 operate in conjunction with each other. Owing to this elevation mechanism 40, the process cartridge 7 according to the present exemplary embodiment is movable between the attachment position and the image forming position. The elevation mechanism is not restricted to a link mechanism. It is only necessary for the elevation mechanism 40 to be a mechanism allowing the attachment lower guide portion 81 and the front cover 73 to operate in conjunction with each other.

As illustrated in FIG. 5A, by being forced-in in the direction of the arrow E, the process cartridge 7 is attached to the image forming apparatus main body 100. Further, as illustrated in FIG. 5B, after the attachment of the process cartridge 7 to the image forming apparatus main body 100 has been completed, the front cover 73 is rotated from the position indicated by the broken line in the direction of the arrow M around the elevation shaft 40*a* to cover the attachment portion 74. As a result, the attachment lower guide portion 81 ascends in the direction of the arrow H in FIG. 5B, and the process cartridge 7 ascends (moves) from the attachment position to the image forming position. At this time, the photosensitive drums 1 provided in the process cartridges 7 abut on the primary transfer rollers 8 via the intermediate transfer belt 5, that is, a state in which image formation is possible is attained. Further, in the order converse to that of attachment, it is possible to extract the process cartridges 7 from the image forming apparatus main body 100.

Figure 6A:
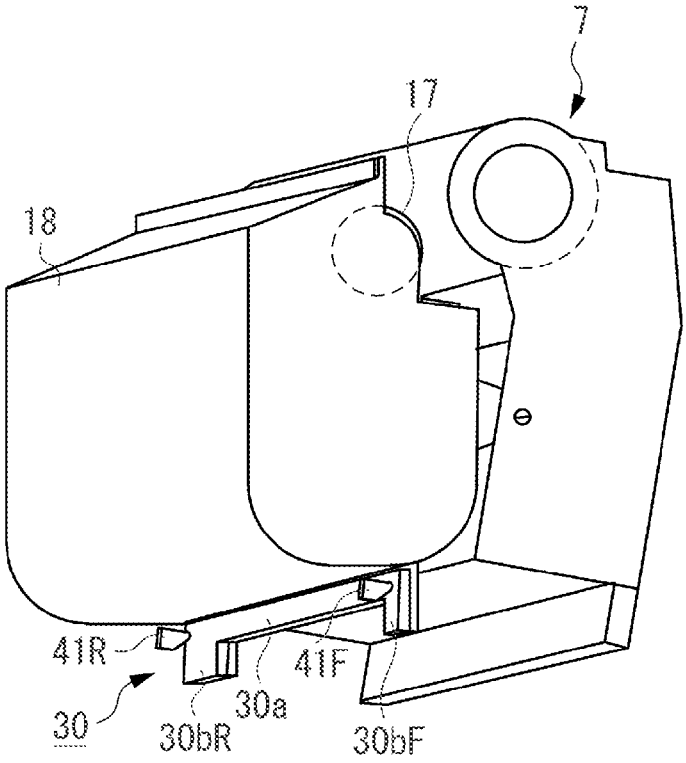
FIGS. 6A and 6B are diagrams illustrating a separation mechanism of the process cartridge according to the present exemplary embodiment.
Figure 6B:
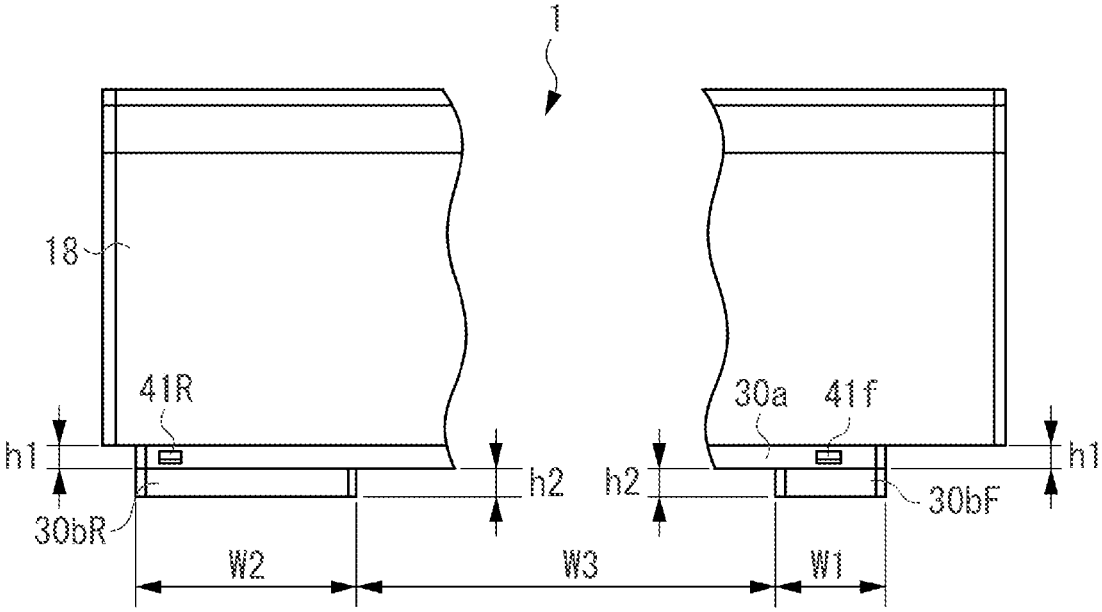

Next, a separation surface (force receiving portion) 30 and a separation member 41 according to the present exemplary embodiment will be described with reference to FIGS. 6A and 6B. FIGS. 6A and 6B are diagrams illustrating a process cartridge separation mechanism according to the present exemplary embodiment. FIG. 6A is a schematic perspective view of the process cartridge according to the present exemplary embodiment, and FIG. 6B is a diagram illustrating a longitudinal end portion of the process cartridge according to the present exemplary embodiment. As illustrated in FIG. 6A, the developing frame member 18 of the process cartridge 7 is provided with a separation surface 30. The separation surface 30 is constituted of a first separation surface (first surface or first portion) 30*a* and a second separation surface 30*b* (second surface or second portion). Further, of the second separation surface 30*b*, the surface provided on the front side (upstream side) in the attachment direction of the process cartridge 7 will be referred to as a second separation surface front portion 30*b*F, and the surface provided on the rear side (downstream side) will be referred to as a second separation surface depth portion 30*b*R. On the other hand, the image forming apparatus main body 100 is provided with a separation member (separation mechanism) 41 having a pressing portion (separation member front portion 41F and separation member rear portion 41R). The separation member 41 is provided so as to be capable of pressing the first separation surface 30*a* in the attachment process and at the attachment position for the process cartridge 7. Further, at the image forming position, the separation member front portion 41F of the separation member 41 can press the second separation surface front portion 30*b*F on the front side in the attachment direction of the process cartridge 7, and the separation member rear portion 41R can press the second separation surface rear portion 30*b*R on the rear side thereof.

As illustrated in FIG. 6B, the first separation surface 30*a* is formed in a height h1 so as to extend along the longitudinal direction of the developing frame member 18 (the axial direction of the photosensitive drum 1). On the other hand, the second separation surface 30*b* is formed on each of the front side and the rear side in the longitudinal direction of the developing frame member 18 so as to be continuous and flush with the first separation surface 30*a*. More specifically, the second separation surface 30*b* is divided into a second separation surface front portion 30*b*F and a second separation surface rear portion 30*b*R which are respectively on the front side and the rear side, and the widths of the developing frame member 18 in the longitudinal direction are respectively W1 and W2, with its height being h2. Further, the distance between the second separation surface front portion 30*b*F and the second separation surface rear portion 30*b*R in the longitudinal direction of the developing frame member 18 is W3. Here, the height h1 of the first separation surface 30*a* is a height allowing the separation member 41 (41F, 41R) to abut on the first separation surface 30*a* when the process cartridge 7 is at the attachment position. The height h2 of the second separation surface 30*b* (30*b*F, 30*b*R) is a height allowing the separation member 41 (41F, 41R) to abut on the second separation surface 30*b* (30*b*F, 30*b*R) when the process cartridge 7 is at the image forming position. Specifically, in the present exemplary embodiment, the first separation surface 30*a* is a surface extending in a length (width) W1+W2+W3 in the longitudinal direction of the developing frame member 18 (the axial direction of the photosensitive drum 1 or the process cartridge inserting direction). The second separation surface 30*b* is a surface extending (protruding) in a length (height) h2 from the first separation surface 30*a* in a direction crossing the longitudinal direction of the developing frame member 18.

Figure 7:
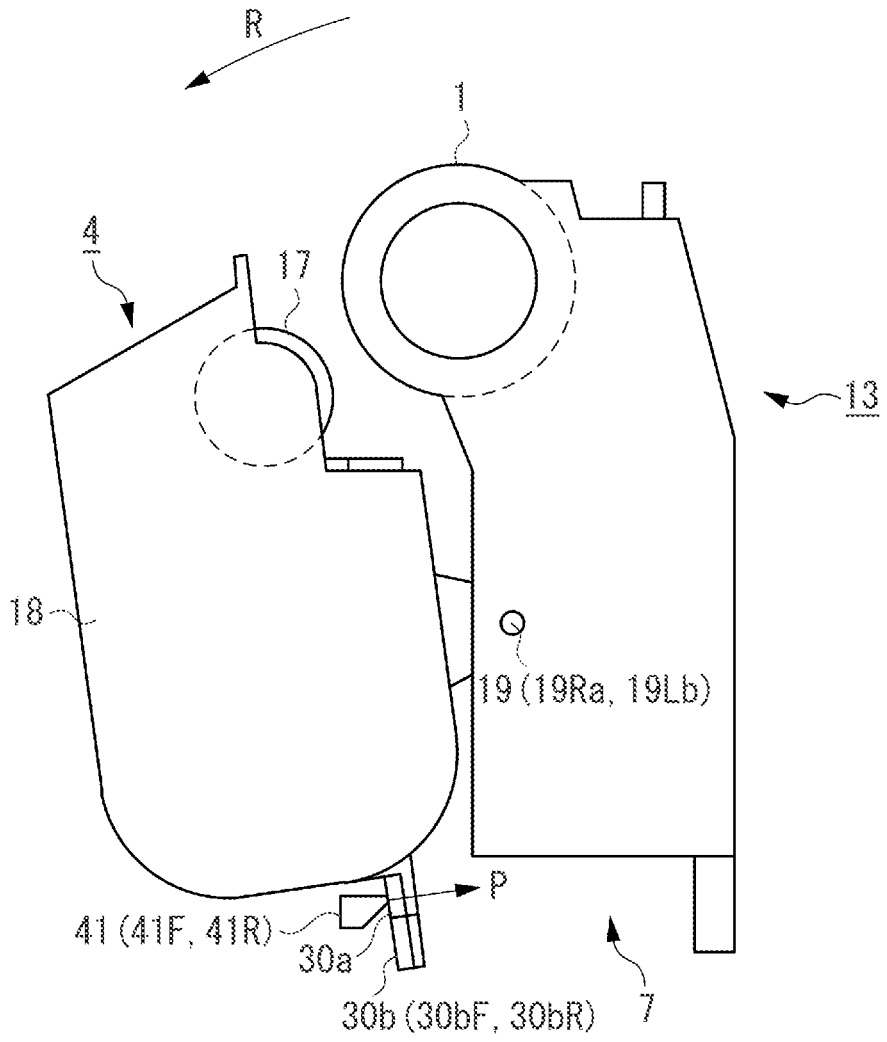
FIG. 7 is a schematic side view illustrating the attachment process for the process cartridge according to the present exemplary embodiment.
Figure 8:
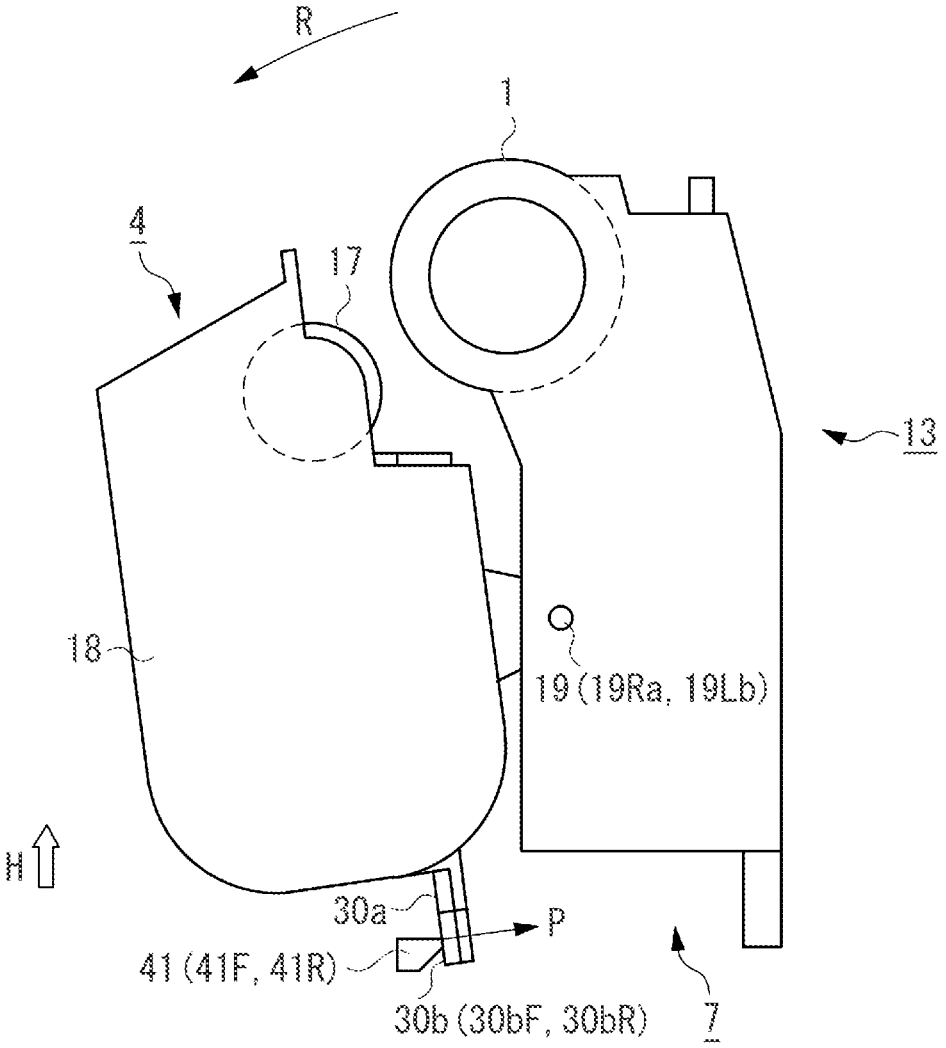
FIG. 8 is a schematic side view of the process cartridge according to the present exemplary embodiment at an image forming position.
Figure 9:
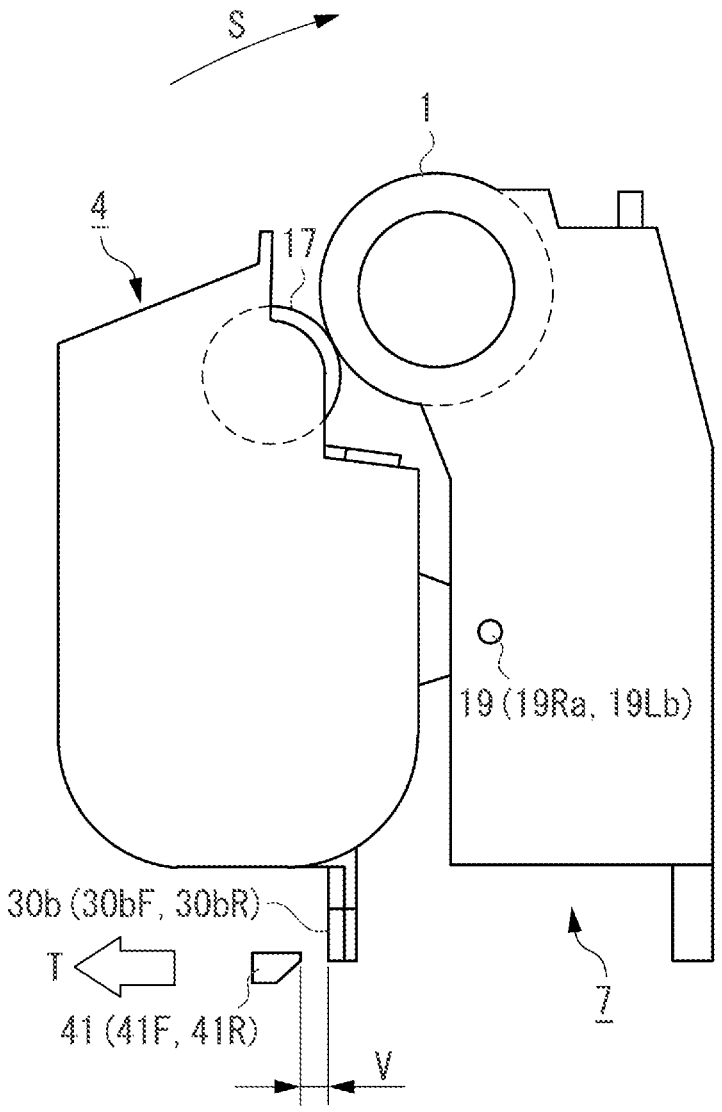
FIG. 9 is a schematic side view of the process cartridge according to the present exemplary embodiment in an abutting state.
Figure 10:
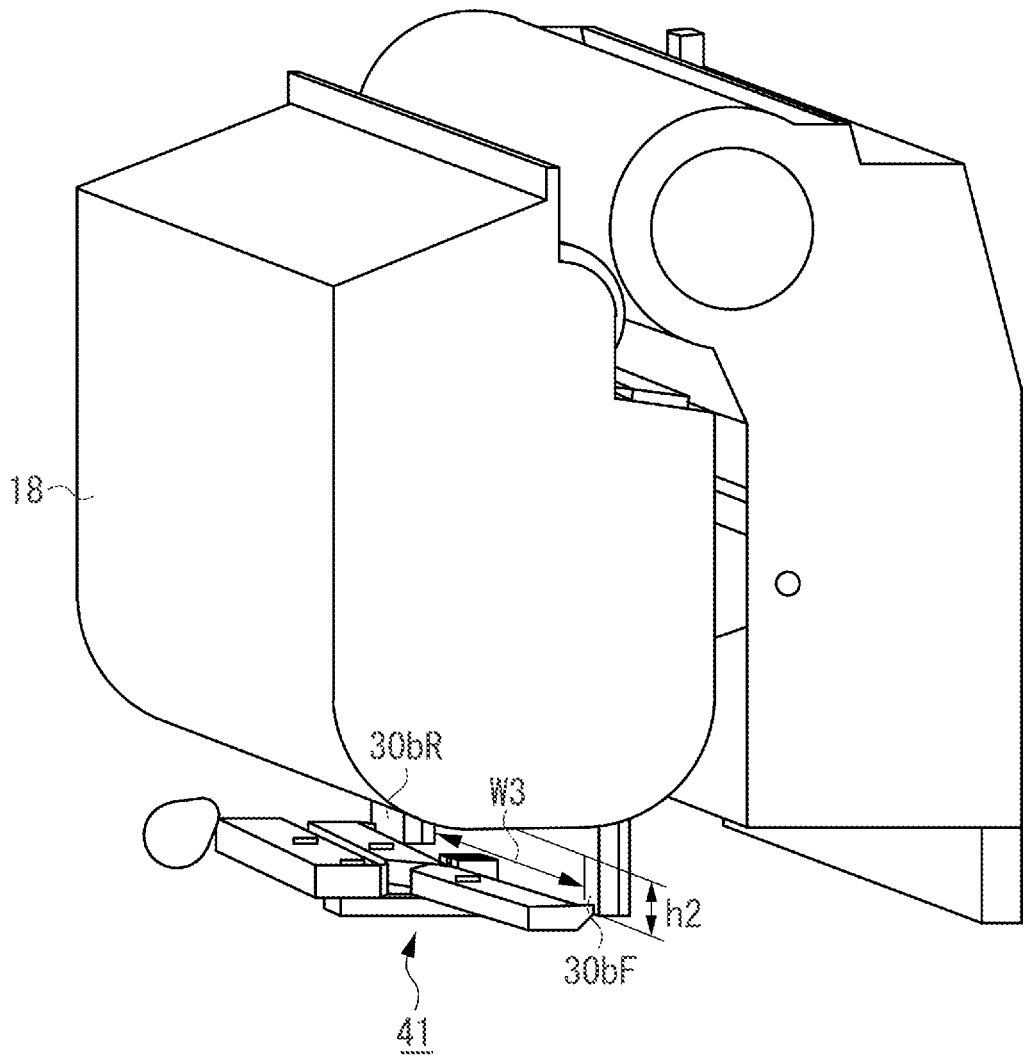
FIG. 10 is a schematic perspective view of the process cartridge according to the present exemplary embodiment in a separating state.
Figure 11:
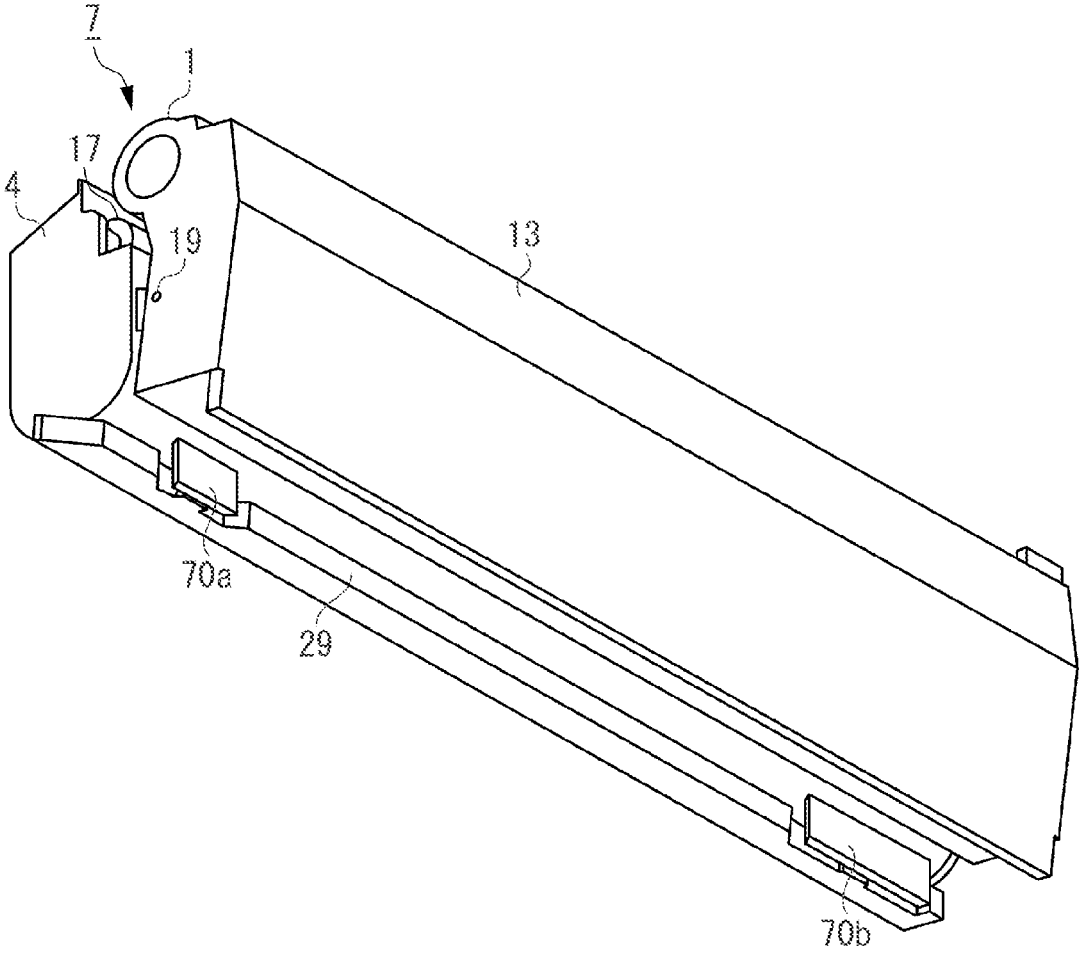
FIG. 11 is a schematic perspective view of a process cartridge according to conventional embodiment.

Next, the abutting and separating operations of the developing roller 17 and the photosensitive drum 1 will be described with reference to FIGS. 7 through 10. FIG. 7 is a schematic side view illustrating the attachment process for the process cartridge according to the present exemplary embodiment. FIG. 8 is a schematic side view of the process cartridge according to the present exemplary embodiment at the image forming position. FIG. 9 is a schematic side view of the process cartridge according to the present exemplary embodiment in the abutting state. FIG. 10 is a schematic perspective view of the process cartridge according to the present exemplary embodiment in the separating state.

The first separation surface 30*a* is formed so as to extend along the path through which the separation member 41 makes relative movement with respect to the developing frame member 18 when the process cartridge 7 moves from the non-attachment position (attachment process) to the attachment position with respect to the image forming apparatus main body 100. In other words, the first separation surface 30*a* extends in the inserting direction of the process cartridge 7 (the direction in which the process cartridge 7 is inserted from the exterior into the interior of the image forming apparatus main body 100). As illustrated in FIG. 7, in the attachment process in which the process cartridge 7 is moving with respect to the image forming apparatus, the first separation surface 30*a* of the developing frame member 18 is pressed by the separation member 41, and the first separation surface 30*a* and the separation member 41 slide on each other. At this time, the first separation surface 30*a* receives a pressing force from the separation member 41 (41F, 41R) in the direction of the arrow P in FIG. 7. Thus, the developing unit 4 rotates in the direction of the arrow R using the fitting holes 19Ra and 19Lb as the swinging center, and the developing roller 17 is separated (in the separating state) with respect to the photosensitive drum 1. The first separation surface 30*a* is formed to extend in the attachment/detachment direction of the process cartridge 7, so that, in the attachment process, the developing roller 17 and the photosensitive drum 1 constantly separate from each other.

Further, as illustrated in FIG. 8, after the process cartridge 7 has been attached to the image forming apparatus main body 100, the process cartridge 7 is raised, at the image forming position where the front cover 73 is closed, in the direction of the arrow H by the elevation mechanism 40 of the image forming apparatus main body 100 as described above. As a result of the ascent of the process cartridge 7, the pressing position of the separation member 41 (41F, 41R) moves from the first separation surface 30*a* to the second separation surface 30*b* (30*b*F, 30*b*R). In other words, the second separation surface 30*b* (30*b*F, 30*b*R) is formed so as to extend from the first separation surface 30*a* along the path through which the separation member 41 makes relative movement with respect to the developing frame member 18 when the process cartridge 7 moves from the attachment position to the image forming position. In this state, the second separation surface 30*b* (30*b*F, 30*b*R) is pressed by the separation member 41 (41F, 41R), and receives a pressing force in the direction of the arrow P in the diagram. Thus, as in the attachment process, the developing unit 4 rotates in the direction of the arrow R using the fitting holes 19Ra, 19Lb as the swinging center, and the developing roller 17 separates from the photosensitive drum 1.

Further, as illustrated in FIG. 9, at the time of image formation, the separation member 41 (41F, 41R) with which the image forming apparatus main body 100 is equipped moves in the direction of the arrow T, and a gap V is formed between the second separation surface 30*b* (30*b*F, 30*b*R) of the process cartridge 7 and the separation member 41. Thus, the pressing of the separation member 41 (41F, 41R) with respect to the second separation surface 30*b* (30*b*F, 30*b*R) is released. Further, as described above, the developing unit 4 is pressed by the pressure spring (see FIG. 2). As a result, the developing unit 4 rotates in the direction of the arrow S using the fitting holes 19Ra, 19Lb as the swinging center, so that the developing roller 17 abuts on the photosensitive drum 1 with a fixed pressure.

Here, the reason why the first separation surface 30*a* and the second separation surface 30*b* are formed so as to be flush with each other in the present exemplary embodiment will be described. As described above, in the attachment process (non-attachment position) and at the attachment position, the first separation surface 30*a* and the separation member 41 abut on each other, and the first separation surface 30*a* is receiving a pressing force from the separation member 41. Then, after the completion of the attachment and at the image forming position, the position of the separation surface 30 receiving the pressing force from the separation member 41 moves from the first separation surface 30*a* to the second separation surface 30*b*. Here, if a step were formed between the first separation surface 30*a* and the second separation surface 30*b*, there would be generated a difference in the pressing force from the separation member 41 to the separation surface 30 (30*a*, 30*b*) between the attachment position and the image forming position. Such a difference in the pressing force between the attachment position and the image forming position would result in deterioration in operability in the attachment operation. In view of this, in the present exemplary embodiment, the first separation surface 30*a* and the second separation surface 30*b* are formed so as to be flush with each other so that the pressing force due to the separation member 41 may be maintained uniform at the attachment position and the image forming position.

Further, the reason for dividing the second separation surface 30*b* provided on the developing frame member 18 into the front side and the rear side will be described. As described above, there is a distance of the width W3 between the second separation surface front portion 30*b*F and the second separation surface rear portion 30*b*R in the longitudinal direction. Due to this configuration, as compared with the case where the second separation surface 30*b* is provided so as to extend over the longitudinal direction, the region of the width W3, where no second separation surface 30*b* is formed, is utilized more efficiently, thereby realizing space saving. For example, as illustrated in FIG. 10, when the separation member 41 constituted by a link mechanism or the like is provided in the image forming apparatus main body 100, and the process cartridge 7 is at the image forming position, movement is possible within the region of the width W3 where no second separation surface 30*b* is formed (the space formed between the two second separation surfaces 30*b*F and 30*b*R). By adopting this configuration by way of example, it is possible for the image forming apparatus to effectively utilize the space within it.

As described above, the process cartridge 7 according to the present exemplary embodiment is configured to be capable of being attached/detached to/from the image forming apparatus main body 100, while the separation surface 30 is pressed by the separation member 41 with a fixed force to maintain separating state. Accordingly, it is possible to achieve an improvement in terms of operability when attaching/detaching the process cartridge 7 to/from the image forming apparatus main body. Further, by effectively utilizing the region formed between the second separation surface front portion 30*b*F and the second separation surface rear portion 30*b*R respectively formed on the upstream side and the downstream side in the longitudinal direction of the developing unit 4, it is possible to realize space saving (a reduction in size) for the image forming apparatus and the process cartridge.

In conclusion, in the configuration as discussed in the present application, it is possible to achieve an improvement in terms of operability when attaching/detaching the process cartridge, and to realize space saving in the image forming apparatus main body. Thus, it is possible to achieve a reduction in the size of an image forming apparatus and of a process cartridge.

While the present disclosure has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-118788 filed May 24, 2012, which is hereby incorporated by reference herein in its entirety.

What is claimed is:

1. A process cartridge detachably attachable to an image forming apparatus main body, the process cartridge comprising:

an image bearing member;

a developer bearing member configured to abut on the image bearing member to thereby develop an electrostatic latent image formed on the image bearing member;

a developing frame member configured to support the developer bearing member and to be capable of assuming an abutting state in which the developer bearing member abuts on the image bearing member and a separating state in which the developer bearing member separates from the image bearing member; and a force receiving portion provided on the developing frame member and configured to allow the developing frame member to enter the separating state by being pressed by a pressing portion provided in the image forming apparatus main body, wherein the process cartridge is configured to be inserted in an inserting direction from an exterior of the image forming apparatus main body into a first attachment position in the image forming apparatus main body, and to be movable, in the image forming apparatus main body, in a direction crossing through the inserting direction from the first attachment position to a second attachment position, wherein the force receiving portion includes a first portion extending along the inserting direction, and second portions provided on each of an upstream side and a downstream side of the first portion in the inserting direction, wherein the second portions protrude from the first portion in the direction crossing through the inserting direction, wherein a portion of the first portion disposed between the second portions in the inserting direction remains abutting on the pressing portion while the process cartridge moves between the exterior of the image forming apparatus main body and the first attachment position and, due to the pressing portion remaining abutting on the portion of the first portion disposed between the second portions, the developing frame member remains in the separating state while the process cartridge moves between the exterior of the image forming apparatus main body and the first attachment position, and wherein the second portions move to abut on the pressing portion when the process cartridge moves between the first attachment position and the second attachment position.

2. The process cartridge according to claim 1, wherein the developing frame member assumes the separating state by the pressing of the pressing portion with respect to the force receiving portion and assumes the abutting state by the pressing of the pressing portion with respect to the force receiving portion being released.

3. The process cartridge according to claim 1, wherein the first portion extends along the axial direction of the image bearing member.

4. The process cartridge according to claim 1, wherein the first portion and the second portions are located in a same plane.

5. The process cartridge according to claim 1, wherein, due to movement of the process cartridge from the first attachment position to the second attachment position, the image bearing member is moved to a position where image formation is possible.

6. The image forming apparatus according to claim 1, the image forming apparatus further comprising a separation mechanism configured to move the pressing portion, wherein the separation mechanism is movable to be positioned within a space provided between the two second portions.

7. The process cartridge according to claim 1, wherein, to maintain a pressing force from the pressing portion against the force receiving portion as the force receiving portion moves from an attachment position to an image forming position, the first portion is formed flush with the second portions.

8. The process cartridge according to claim 1, wherein, the second portions are separated by a width where no second portion is formed, wherein a separation mechanism of the image forming apparatus is movable to be positioned within the space provided between the two second portions.

9. An image forming apparatus configured to form an image on a recording material, the image forming apparatus comprising:

a pressing portion configured to press a force receiving portion provided on a process cartridge; and the process cartridge detachably attachable to an image forming apparatus main body, wherein the process cartridge includes:

an image bearing member, a developer bearing member configured to abut on the image bearing member to thereby develop an electrostatic latent image formed on the image bearing member, a developing frame member configured to support the developer bearing member and to be capable of assuming an abutting state in which the developer bearing member abuts on the image bearing member and a separating state in which the developer bearing member separates from the image bearing member, and the force receiving portion provided on the developing frame member and configured to allow the developing frame member to enter the separating state by being pressed by the pressing portion provided in the image forming apparatus main body, wherein the process cartridge is configured to be inserted in an inserting direction from an exterior of the image forming apparatus main body into a first attachment position in the image forming apparatus main body, and to be movable, in the image forming apparatus main body, in a direction crossing through the inserting direction from the first attachment position to a second attachment position, wherein the force receiving portion includes a first portion extending along the inserting direction, and second portions provided on each of an upstream side and a downstream side of the first portion in the inserting direction, wherein the second portions protrude from the first portion in the direction crossing through the inserting direction, wherein a portion of the first portion disposed between the second portions in the inserting direction remains abutting on the pressing portion while the process cartridge moves between the exterior of the image forming apparatus main body and the first attachment position and, due to the pressing portion remaining abutting on the portion of the first portion disposed between the second portions, the developing frame member remains in the separating state while the process cartridge moves between the exterior of the image forming apparatus main body and the first attachment position, and wherein the second portions move to abut on the pressing portion when the process cartridge moves between the first attachment position and the second attachment position.

10. The image forming apparatus according to claim 9, wherein the second portions includes an upstream second portion provided on the upstream side of the first portion and a downstream second portion provided on the downstream side of the first portion, wherein, the force receiving portion includes a space formed between the upstream second portion and the downstream second portion, wherein the image forming apparatus further comprises a separation mechanism configured to move the pressing portion, and wherein the separation mechanism is movable to be positioned within the space provided between the two second portions.

11. The image forming apparatus according to claim 9, wherein the first portion extends along the axial direction of the image bearing member.

12. The image forming apparatus according to claim 9, wherein the first portion and the second portions are provided in a same plane flush with each other to maintain a pressing force from the pressing portion against the force receiving portion as the force receiving portion moves from the first attachment position to the second attachment position.

13. The image forming apparatus according to claim 9, wherein the developing frame member assumes the separating state by the pressing of the pressing portion with respect to the force receiving portion and assumes the abutting state by the pressing of the pressing portion with respect to the force receiving portion being released.

14. The image forming apparatus according to claim 9, wherein, due to movement of the process cartridge from the first attachment position to the second attachment position, the image bearing member is moved to a position where image formation is possible.

15. The image forming apparatus according to claim 9, further comprising a moving mechanism configured to move the process cartridge between the first attachment position and the second attachment position.

16. The image forming apparatus according to claim 15, further comprising a door and an opening/closing attachment portion to which the process cartridge is attached, wherein the moving mechanism retains the process cartridge at the first attachment position when the door is opened, and retains the process cartridge at the second attachment position when the door is closed.

17. An image forming apparatus configured to form an image on a recording material, the image forming apparatus comprising:

a pressing portion configured to press a force receiving portion provided on a process cartridge, the process cartridge detachably attachable to an image forming apparatus main body, wherein the process cartridge includes:

an image bearing member, a developer bearing member configured to abut on the image bearing member to thereby develop an electrostatic latent image formed on the image bearing member, a developing frame member configured to support the developer bearing member and to be capable of assuming an abutting state in which the developer bearing member abuts on the image bearing member and a separating state in which the developer bearing member separates from the image bearing member, and the force receiving portion provided on the developing frame member and configured to allow the developing frame member to enter the separating state by being pressed by the pressing portion provided in the image forming apparatus main body, wherein the force receiving portion includes a first portion configured to abut on the pressing portion when the process cartridge is inserted from an exterior of the image forming apparatus main body into an interior of the image forming apparatus main body and to extend along the inserting direction of the process cartridge, and includes two second portions, one provided on each of an upstream side and on a downstream side of the first portion in the inserting direction, wherein each second portion extends from the first portion in a direction crossing through the inserting direction, and is configured to abut on the pressing portion when the process cartridge is at a position where image formation is possible, and wherein, the force receiving portion has a space formed between the two second portions provided on the upstream side and the downstream side of the first portion; and a separation mechanism configured to move the pressing portion, wherein the separation mechanism is movable to be positioned within the space provided between the two second portions.

18. The image forming apparatus according to claim 17, further comprising a door and an opening/-closing attachment portion to which the process cartridge is attached, wherein the moving mechanism retains the process cartridge at the first attachment position when the door is opened, and retains the process cartridge at the second attachment position when the door is closed.

19. The image forming apparatus according to claim 17, wherein the first portion extends along the axial direction of the image bearing member.

20. The image forming apparatus according to claim 17, wherein the first portion and the two second portions are provided in a same plane.

21. The image forming apparatus according to claim 17, wherein the developing frame member assumes the separating state by the pressing of the pressing portion with respect to the force receiving portion and assumes the abutting state by the pressing of the pressing portion with respect to the force receiving portion being released.

22. The image forming apparatus according to claim 17, further comprising a moving mechanism configured to move the process cartridge, in the image forming apparatus main body, between a first attachment position and a second attachment position which is different from the first attachment position, wherein, by movement of the process cartridge from the first attachment position to the second attachment position, the developing frame member is moved with respect to the pressing portion and the image bearing member is positioned to a position where image formation is possible, wherein the first portion extends along a direction in which the developing frame member moves with respect to the pressing portion when the process cartridge moves from the exterior of the image forming apparatus main body to the first attachment position, and the two second portions extends from the first portion along a direction in which the developing frame member moves with respect to the pressing portion when the process cartridge moves from the first attachment position to the second attachment position.

* * * * *